US006420026B1

(12) United States Patent
Okamoto et al.

(10) Patent No.: US 6,420,026 B1
(45) Date of Patent: Jul. 16, 2002

(54) COMPOSITE FILAMENT, PROCESS FOR THE PRODUCTION OF THE SAME, AND HEAT FUSED ARTICLE

(75) Inventors: Hiroshi Okamoto, Owari-asahi; Shin-ichi Inoue, Tokoname; Tetsuo Kanagawa, Toyota; Masataka Sano, Hamamatsu; Hiroki Miyamatsu, Hamamatsu; Kimi Yoshida, Hamamatsu; Nobuo Goto, Ichihara; Akira Yamanaka, Moriyama; Tomio Yamazawa, Minamata; Takahiro Sugimoto, Ichihara, all of (JP)

(73) Assignees: Kabushiki Kaisha Erubu, Hamamatsu; Chisso Corporation, Osaka, both of (JP)

( * ) Notice: Subject to any disclaimer, the term of this patent is extended or adjusted under 35 U.S.C. 154(b) by 0 days.

(21) Appl. No.: 09/663,708

(22) Filed: Sep. 18, 2000

(30) Foreign Application Priority Data

Sep. 21, 1999 (JP) ..... 11-267694

(51) Int. Cl.[7] ..... D01F 8/00
(52) U.S. Cl. ..... 428/370; 425/373; 425/374
(58) Field of Search ..... 428/370, 373, 428/374; 523/102; 424/405; 426/49

(56) References Cited

U.S. PATENT DOCUMENTS 5,747,053 A * 5/1998 Nashimoto et al. ..... 424/405
5,888,527 A * 3/1999 Nashimoto et al. ..... 424/405
6,156,817 A * 12/2000 Okamoto et al. ..... 523/102
6,254,902 B1 * 7/2001 Hodges et al. ..... 426/49

FOREIGN PATENT DOCUMENTS

JP 7-148407 6/1995

* cited by examiner

*Primary Examiner*—N. Edwards
(74) *Attorney, Agent, or Firm*—Armstrong, Westerman, & Hattori, LLP

(57) ABSTRACT

The invention is aimed to provide a core-sheath type composite filament, in which a functional component is hardly lost due to volatilization during the melt forming; bleeding of the internally added functional component is effectively inhibited; the internally added functional component does not adversely affect spinning properties, stretching properties, strength and dimensional stability; the use of the functional component can be greatly reduced, leading to a reduction of production cost; superior functionalities of deodorizing properties and antimicrobial properties can be exhibited to a maximum extent; even when contacting with water, the functionalities can be kept over a long time; and the composite filament is highly safe to a human body. The invention is also aimed to provide a process for the production of the core-sheath type composite filament as well as a heat fused article obtained from the composite filament. The core-sheath type composite filament of the invention is composed of a core component X and a sheath component Y, wherein the core component X is formed from a first polyolefin resin (H), and the sheath component Y is formed from a second polyolefin resin (L) compounded with at least one functional component (A) selected from the group consisting of a catechin, a saponin, a tea-leaf powder, a tea-leaf extract, and tannin (tannic acid), and a ceramics component (C).

6 Claims, 1 Drawing Sheet

(i)
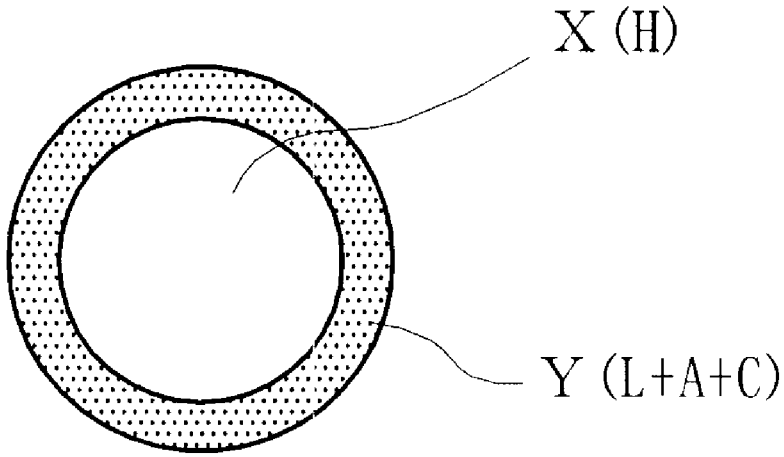
(ii)
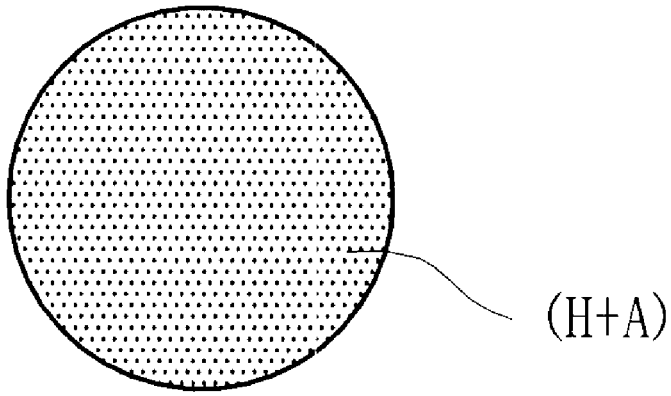

COMPOSITE FILAMENT, PROCESS FOR THE PRODUCTION OF THE SAME, AND HEAT FUSED ARTICLE

BACKGROUND OF THE INVENTION

1. Field of the Invention

The present invention relates to a core-sheath type composite filament having superior functionalities (e.g., deodorizing properties, antimicrobial properties), spinning properties, stretching properties, physical properties (e.g., strength, dimensional stability), and economy (i.e., cost), which is useful for various applications including filters of air conditioners or air cleaners, and to a process for the production of the same. Also, the invention relates to a heat fused article obtainable from such a composite filament.

2. Description of the Conventional Art

As filters to be incorporated into air conditioners or air cleaners, filters made of a polypropylene filament that is not only advantageous from the standpoint of production cost but also superior in characteristics such as moldability, mechanical strength, water resistance, and chemical resistance, are widely used.

It is also known that polypropylene for a filter is incorporated with a synthetic bactericide or carried with a catechin as a tea-extraction component, through external attachment or internal addition.

For example, Japanese Patent Laid-Open No. 99656/1989 mentions an antibacterial electret filter comprising polypropylene fibers having 0.1% or more of a bactericide incorporated therein. However, the bactericide that is used in the examples of this patent publication is thiabendazole as a synthetic bactericide.

Further, Japanese Patent Laid-Open No. 148407/1995 describes an antiviral filter comprising a filter impregnated with, or a filter material incorporated with, a virus-inactivating agent comprising, as an active ingredient, a tea-extraction component. The tea-extraction component as referred to herein means a tea polyphenol such as a catechin. In the examples of this patent publication are given (A) an example in which the tea-extraction component is dissolved in water to prepare an aqueous solution, which is then impregnated and attached to an electret filter; and (B) an example in which polypropylene is mixed with the tea-extraction component, and the mixture is molten to form a film, which is then cut and fabricated into a non-woven fabric.

Moreover, Japanese Patent Laid-Open No. 266828/1996 describes an antiviral filter comprising a dust-collecting filter and a filter impregnated with a tea-extraction component. The tea-extraction component as referred to herein means a tea polyphenol such as a catechin. Further, the filer impregnated with a tea-extraction component as referred to herein means an electret filter, an HEPA filter, a high-performance filer, a middle-performance filter, a bag filter, etc.

In addition, Japanese Patent Publication No. 3969/1988 (Japanese Patent No. 1,456,233) owned by one of the present applicants describes a composite monofilament comprising high-melting polypropylene as a core component and a low-melting polyolefin as a sheath component. This patent publication also mentions that this monofilament is fabricated into a net-like state. However, this patent publication does not describe that the monofilament is carried with an active ingredient such as a bactericide. In this monofilament, since not only a necessary strength is obtained by the core component, but also heat fusion properties are obtained by the sheath component, it is easy to fabricate it into a net-like state or a non-woven fabric-like state.

In the case where the tea-extraction component is dissolved in water to prepare an aqueous solution, which is then externally impregnated and carried in a filter, namely, in the attachment and carrying method by impregnation, the tea-extraction component is compatible with water, and hence, fixing properties and waterproof properties are not sufficient. Therefore, when this filter is used upon being brought into contact with water, or is used while often washing with water, it involves such a defect that the tea-extraction component as an attaching component is readily lost.

In the method in which the tea-extraction component such as a catechin is internally added to (i.e., incorporated into) polypropylene as a filter material and then melt formed, since the tea-extraction component such as a catechin, which is originally soluble in water, is incompatible with polypropylene as a non-polar resin, it likely bleeds out onto the filament surface to generate stains. Further, when the filament is dipped in water or washed with water, a major part of the extraction component elutes out, whereby the effect is drastically reduced. Even when the internal addition amount is increased taking into consideration of the bleeding-out, the elution amount is still high during contact with water. Accordingly, it is inevitable that not only the production cost is high, but also the spinning properties, stretching properties and strength are reduced. In addition, in this internal addition method, during the melt forming, a considerable amount of an effective part of the tea-extraction component is volatilized out, and hence, it is inevitable that the relatively expensive active ingredient is lost.

SUMMARY OF THE INVENTION

Under such circumstances, the present invention is aimed to provide a core-sheath type composite filament, in which a functional component is hardly lost due to volatilization during the melt forming; bleeding of the internally added functional component is effectively inhibited; the internally added functional component does not adversely affect spinning properties, stretching properties, and physical properties (e.g., strength, dimensional stability); the internal addition amount of the functional component can be greatly reduced, leading to an advantage from the standpoint of production cost; superior functionalities (e.g., deodorizing properties, antimicrobial properties), which the functional component inherently possesses, can be exhibited to a maximum extent; even when used upon contact with water, the composite filament is durable so that the functionalities can be kept over a long period of time; and even when used upon contact with a human body, the composite filament is high in safety. The present invention is also aimed to provide a process for the production of the core-sheath type composite filament as well as a heat fused article obtained from the composite filament.

Specifically, the composite filament according to the present invention is a core-sheath type composite filament comprising a core component X and a sheath component Y, wherein the core component X is formed from a first polyolefin resin (H), and the sheath component Y is formed from a second polyolefin resin (L) compounded with at least one functional component (A) selected from the group consisting of a catechin, a saponin, a tea-leaf powder, a tea-leaf extract, and tannin (tannic acid), and a ceramics component (C).

The process for the production of the composite filter according to the present invention comprises co-extrusion forming a first polyolefin resin (H) and a second polyolefin resin (L) compounded with at least one functional component (A) selected from the group consisting of a catechin, a saponin, a tea-leaf powder, a tea-leaf extract, and tannin (tannic acid), and a ceramics component (C) at a temperature higher than melting temperatures of the respective components, such that the first polyolefin resin (H) becomes a core component X and that the second polyolefin resin (L) compounded with the functional component (A) and the ceramics component (C) becomes a sheath component Y, thereby obtaining a core-sheath type composite filter constructed of the core component X and the sheath component Y.

The heat fused article in a net-like state according to the present invention is comprised of a heat fused material of a textile made of the above-described composite filament. Further, the heat fused article in a non-woven fabric state according to the present invention is comprised of a heat fused material of the above-described composite filament.

BRIEF DESCRIPTION OF THE DRAWING

FIG. 1(i) is a schematically cross-sectional view of the composite monofilament obtained in Example 1; and FIG. 1(ii) is a schematically cross-sectional view of the monofilament obtained in Comparative Example 1.

DETAILED DESCRIPTION OF THE INVENTION

The invention is described below in detail.

(Composite Filament)

The composite filament according to the present invention is a core-sheath type composite filament constructed of the core component X and the sheath component Y. So far as the composite filament is of a core-sheath type, any core-sheath types such as a concentric core-sheath type, an eccentric core-sheath type, and a polycentric core-sheath type may be employed.

(Core Component X)

In the present invention, the core component X is formed of the first polyolefin resin (H). Examples of the first polyolefin resin (H) include polypropylene and polyethylene. Such polypropylene and polyethylene may be a single component, or a mixture of different grades or different types in an arbitrary mixing ratio. Further, while, in many cases, the first polyolefin resin (H) has a melting point higher than the second polyolefin resin (L), such is not a must.

The polypropylene as referred to herein includes not only a propylene homopolymer but also copolymers with ethylene or α-olefins such as butene-1. In many cases, the polypropylene has a melt flow rate (as defined later in the Examples) of from 0.3 to 400, and preferably from 0.5 to 200. A typical example of the polypropylene is a propylene homopolymer having a melting point of, for example, 150° C. or higher. A composite filament comprising such high-melting polypropylene as the core component X is particularly preferred from the standpoints of spinning properties, stretching properties, physical properties (e.g., strength, dimensional stability), and the like.

Examples of the polyethylene include low-density polyethylene, linear low-density polyethylene, and high-density polyethylene. The polyethylene includes not only an ethylene homopolymer but also copolymers comprising ethylene as a major component with propylene or α-olefins such as butene-1. In many cases, the polyethylene has a melt index (as defined later in the Examples) of from 0.1 to 100, and preferably from 0.2 to 80.

(Sheath Component Y)

On the other hand, the sheath component Y is formed from the second polyolef in resin (L) having the functional component (A) and the ceramics component (C) compounded therein. As the second polyolef in resin (L), polypropylene and polyethylene can be used, too. Such polypropylene and polyethylene may be a single component, or a mixture of different grades or different types in an arbitrary mixing ratio.

The polypropylene as referred to herein includes not only a propylene homopolymer but also copolymers with ethylene or α-olefins such as butene-1. In many cases, the polypropylene has a melt flow rate (as defined later in the Examples) of from 0.3 to 400, and preferably from 0.5 to 200.

Examples of the polyethylene include low-density polyethylene, linear low-density polyethylene, and high-density polyethylene. The polyethylene includes not only an ethylene homopolymer but also copolymers comprising ethylene as a major component with propylene or α-olefins such as butene-1. In many cases, the polyethylene has a melt index (as defined later in the Examples) of from 0.1 to 100, and preferably from 0.2 to 80.

In the case where the resulting composite filament is required to have heat fusion properties, in many cases, it is preferred to use a polyolefin, as the second polyolefin resin (L), having a melting point lower (preferably lower by at least 5° C.) than that of the first polyolefin resin (H) as described above, such as polyethylene, ethylene copolymers, and propylene copolymers.

As the functional component (A) is used at least one member selected from the group consisting of a catechin, a saponin, a tea-leaf powder, a tea-leaf extract, and tannin (tannic acid). These are a component having functionalities such as deodorizing properties (e.g., deodorizing properties, smell-eliminating properties, toxic gas-removing properties), antimicrobial properties (e.g., antibacterial properties, bactericidal properties, bacteriostatic properties, fungicidal properties, antiviral properties), physiological activity (e.g., antiallergic properties), and antioxidation properties.

Of these, as the catechin are used monomeric compounds and oligomeric compounds (including theaflavin). Those that are particularly important as the catechin are tea-originated catechin formulations in which the catechin concentration is increased. Major components of the catechin are epigallocatechin, epigallocatechin gallate, epicatechin, epicatechin gallate, etc. Since these components are not required to be isolated from each other, a formulation containing the tea catechin in a high concentration, comprising a mixture of these components (particularly those containing the tea catechin 20% or more, and preferably those containing the tea catechin) 25% or more, can be suitably used as it stands. The tea-originated catechin formulation is readily available because the commercially available tea-originated catechin formulation includes 30% products, 50% products, 60% products, 70% products, 80% products, and 90% products. The catechin is contained in various kinds of plants other than teas, such as catechu, and hence, catechins originated from such plants are also useful.

Among the saponins, tea saponin can be obtained by extracting a saponin-containing component with an organic solvent or water from tea leaves or tea seeds and then repeatedly purifying by means of column chromatography, etc. Though the tea saponin includes steroid-based saponin and triterepenoid-based saponin, any of them can be used for the object of the present invention. Since the saponin is also contained in various kinds of plants other than teas, such as ginseng (ginseng radix), *panacis japonici rhizoma*, soybean (*Glycine max* MERR.), bupleurum root (bupleuri radix), *hydrangeae dulcis folium*, loofah (*Luffa cylindrica M. Roemen*), polygala root (polygalae radix), platycodon root (platicodi radix), senega (senegae radix), ophiopogon tuber (ophiopogonis tuber), akebia stem (akebiae caulis), *anemarrhena rhizome* (*anemarrhenae rhizoma*), achyranthes root (achyranthis radix), licorice root (glycyrrhizae radix), and smilax rhizome (smilacis rhizoma), saponins made from these plants can also be used.

Examples of the tea-leaf powder or tea-leaf extract which can be used include powders or extracts of teas, such as the first pick of tea, the second pick of tea, the third pick of tea, deeply steamed tea, and kabusecha.

As the tannin (tannic acid), commercially available purified tannic acid can be used. Extracts or semi-purified products of natural plants containing tannic acid, such as Chinese gallotannin and Turkish gallotannin, can be used as they stand.

As the ceramics component (C) are useful various kinds of ceramics. Of these are suitably used a silica gel obtained via a hydrous silicate gel, a combination of an inorganic sintering aid and an inorganic flocculant, and a combination of ceramics particles, an inorganic sintering aid and an inorganic flocculant, as described below in detail.

As the silica gel is suitably used a silica gel obtained via a hydrous silicate gel. At this time, an aqueous solution of a silicate is mixed with an acid to adjust the pH, and the thus obtained hydrous gel is further washed with water to remove ions and then dried to obtain a desired silica gel. Examples of the silicate include sodium silicate represented by $Na_2O.nSiO_2$ and potassium silicate represented by $K_2O.nSiO_2$, with the former sodium silicate being particularly important. A concentrated aqueous solution of the silicate is generally called as a water glass, and typical commercially available water glasses have an $SiO_2$ content of from 22 to 38% by weight and an $Na_2O$ content of from 5 to 19% by weight.

Examples of the inorganic sintering aid include polyvalent metal salts of an inorganic acid such as phosphoric acid, sulfuric acid, nitric acid, and carbonic acid, and fluorides or silicofluorides of an alkali metal or an alkaline earth metal. As the polyvalent metal salts are suitably used those -of aluminum, zinc, magnesium, calcium, or manganese. They are usually put into use in a state where a hydrous salt or hydrate is dissolved in water.

Suitable examples of the inorganic flocculant include inorganic flocculants in a state of sol or solution and particularly, silicic anhydride in a state of sol or silicates (such as sodium silicate and potassium silicate) in a state of solution. The silicic anhydride in a state of sol includes not only usual colloidal silica that uses water as a medium but also an organosilica sol that uses an organic solvent such as an alcohol, as a medium.

Examples of the ceramics particles in the combination of ceramics particles, an inorganic sintering aid and an inorganic flocculant include various clay minerals, oxides, hydroxides, composite oxides, nitrides, carbides, silicides, borides, zeolite, cristobalite, diatomaceous earth, and polyvalent metal salts of silicic acid. Examples of the clay minerals include kaolin, agalmatolite, sericite, and bentonite. Examples of the oxides include alumina, titania, silica, zirconia, and magnesia. Examples of the hydroxides include hydroxides of aluminum, zinc, magnesium, calcium, and manganese. Examples of the composite oxides include alums. Examples of the nitrides include silicon nitride and boron nitride. Examples of the carbides include silicon carbide and boron carbide. Examples of the polyvalent metal salts of silicic acid include aluminum salts, zinc salts, magnesium salts, calcium salts, and manganese salts.

With respect to the proportion of the respective components, in the combination of an inorganic sintering aid and an inorganic flocculant, in many cases, the amount of the inorganic flocculent is from about 100 to 300 parts by weight in terms of solids content, or more, based on 100 parts by weight of the solids content of the inorganic sintering aid. And, in the combination of ceramics particles, an inorganic sintering aid and an inorganic flocculent, those amounts at which the ceramics particles as a major component as well as the inorganic sintering aid and the inorganic flocculant can play the respective roles are employed. In many cases, the amounts of the inorganic sintering aid and the inorganic flocculant are from about 0.5 to 20 parts by weight and from 0.5 to 25 parts by weight in terms of solids content, respectively based on 100 parts by weight of the ceramics particles.

As described previously, the sheath component Y is formed from the second polyolefin resin (L) having the functional component (A) and the ceramics component (C) compounded therein. In this case, though the functional component (A) and the ceramics component (C) may be respectively compounded in the second polyolefin resin (L), it is preferred that after composite particles comprising the functional component (A) and the ceramics component (C) have been prepared in advance, the composite particles are compounded in the second polyolefin resin (L).

In the case where the composite particles are prepared, when the ceramics component (C) is a silica gel obtained via a hydrous silicate gel, it is desired that the functional component (A) is added to the system before, during or after mixing the aqueous solution of the silicate and the acid but before the completion of the gelation reaction, thereby containing the functional component (A) in the silica gel.

In the case where the ceramics component (C) is a combination of an inorganic sintering aid and an inorganic flocculant, it is preferred that the ceramics are flocculated in a state containing the functional component (A). One example is given below. An aqueous solution of aluminum phosphate as an example of the inorganic sintering aid is mixed with the functional component (A) as a powder or an aqueous or alcoholic solution; the pH is adjusted at from 3 to 4; and the mixture is further mixed with a colloid solution of colloidal silica as an example of the inorganic flocculant, thereby making the system have a pH to an approximately neutral degree. At this time, since flocculation takes place, the flocculation product is placed in a crucible or on an evaporating dish and then subjected to a heat treatment in a dryer or an electric furnace until it has become dried.

In the case where the ceramics component (C) is a combination of ceramics particles, an inorganic sintering aid and an inorganic flocculant, it is preferred that the ceramics are flocculated in a state containing the functional component (A). One example is given below. An aqueous solution of aluminum phosphate as an example of the inorganic sintering aid is added to and kneaded with particles of ceramics such as aluminum silicate, alumina, and titania so as to have a viscosity to a degree of an approximately stiff paste, and subsequently, the kneaded mixture is mixed with the functional component (A) as a powder or an aqueous or alcoholic solution (alternatively, after mixing the functional component (A) with the ceramics particles, the inorganic sintering aid is kneaded therewith). Further, an aqueous solution of aluminum phosphate is additionally mixed, if desired. And, the pH is adjusted at from 3 to 4, and the mixture is further mixed with a colloid solution of colloidal silica as an example of the inorganic flocculent, thereby making the system have a pH to an approximately neutral degree. At this time, since flocculation takes place, the flocculation product is placed in a crucible or on an evaporating dish and then subjected to a heat treatment in a dryer or an electric furnace until it has become dried.

With respect to the proportions of the second polyolefin resin (L), the functional component (A) and the ceramics component (C) accounting for in the sheath component Y, it is desired that a total amount of the functional component (A) and the ceramics component (C) is from 1 to 40 parts by weight (preferably from 2 to 30 parts by weight) based on 100 parts by weight of the second polyolefin resin (L). When the total amount of the functional component (A) and the ceramics component (C) is too low, the desired functionalities such as deodorizing properties, antimicrobial properties, physiological activity, and antioxidation properties are not thoroughly exhibited. On the other hand, when the total amount of the functional component (A) and the ceramics component (C) is too high, negative features become conspicuous so that not only the functionalities do not increase exceeding a certain extent, but also the productivity of the composite filament is lowered, and the strength and drape are lowered.

With respect to the relation between the functional component (A) and the ceramics component (C), it is desired that an amount of the functional component (A) is from 1 to 300 parts by weight (preferably from 2 to 200 parts by weight, and more preferably from 3 to 150 parts by weight) based on 100 parts by weight of the ceramics component (C). When the amount of the functional component (A) is too low, the desired functionalities such as deodorizing properties, antimicrobial properties, physiological activity, and antioxidation properties are not sufficient. On the other hand, when the amount of the functional component (A) is too high, a balance to the ceramics component (C) is lost, leading to a disadvantage from the standpoint of cost. (Proportion of the core component X to the sheath component Y)

A suitable proportion of the core component X to the sheath component Y in the composite filament is from 30:70 to 80:20, and particularly from 35:65 to 75:25, on a weight basis. When the proportion of the sheath component Y is too low, since the proportion of the functional component (A) is too low, the desired functionalities are not thoroughly exhibited. Further, when the resulting filament is required to have heat adhesion, the heat adhesion is insufficient. On the other hand, when the proportion of the sheath component Y is too high, since the proportion of the core component X is relatively too low, the resulting filament is liable to be not satisfied from the standpoints of spinning properties, stretching properties, strength, dimensional stability, etc.

(Production of the Composite Filament)

The above-described composite filament can be produced by co-extrusion forming the first polyolef in resin (H) and the second polyolef in resin (L) compounded with the functional component (A) and the ceramics component (C) at a temperature higher than melting temperatures of the respective components, such that the first polyolefin resin (H) becomes the core component X and that the second polyolef in resin (L) compounded with the functional component (A) and the ceramics component (C) becomes the sheath component Y. The co-extrusion forming can be attained by linearly discharging the first polyolefin resin (H) and the second polyolefin resin (L) from composite dies using two extruders. Depending on circumstances, the both resins are formed into a net-like state by using rotating dies. In this connection, in the side of the second polyolef in resin (L), a master batch in which the concentration of the material to be internally added is high may be previously prepared and then mixed with the second polyolefin resin (L), followed by providing for the forming.

If desired, in both of the side of the first polyolefin resin (H) and the side of the second polyolefin resin (L), auxiliary agents such as antioxidants, ultraviolet light absorbers, colorants, lubricants, antistatic agents, matting agents, fluidity improvers, plasticizers, and flame retardants can be internally added. In particular, it is preferred that, in the side of the second polyolef in resin (L) compounded with the functional component (A) and the ceramics component (C), forming aids effective for improving the flocculation prevention or the dispersibility, inclusive of metallic soaps, are compounded together with stabilizers such as antioxidants, thereby ensuring homogenous dispersion of the functional component (A) and the ceramics component (C) (particularly, composite particles comprising the both). Further, in order to improve supporting properties of the functional component (A), suitable amounts of metal ion sources such as copper salts, iron salts, calcium salts, titanium salts, aluminum salts, silver salts, tin salts, zinc salts, chromium salts, and cobalt salts can be made coexistent.

In many cases, after the co-extrusion forming, drawing is carried out. While the drawing ratio is not particularly limited, when the drawing ratio is too low, the strength tends to be insufficient depending on the use. The drawing ratio is usually 3 or more, and particularly 4 or more. On the other hand, when the drawing ratio is too high, a trouble in which ply separation likely occurs between the core and the sheath may be found. Accordingly, an upper limit of the drawing ratio is generally about 10. Further, since the drawing is not required depending on the use, the drawing is not essential.

(Application and Use)

A size of the composite filament according to the present invention is arbitrary from an extra thin denier to an extra thick denier. It is unrestricted to obtain secondary products such as nets, ropes, belts, yarns, piles, cotton-likematerials, woven fabrics, non-woven fabrics, and knitted fabrics, from the composite filament. The composite filament or secondary products thereof can be used in combination with fibers or monofilaments such as natural fibers (e.g., cotton, hemp, silk, wool, etc.), fibers or monofilaments of synthetic resins (e.g., polyesters, acrylic reins, polypropylene, polyethylene, nylons, vinylons, polyvinylidene chloride, polyvinyl chloride, polyurethane, etc.), semi-synthetic fibers (e.g., acetate fibers, etc.), regenerated fibers (e.g., rayon, etc.), and inorganic fibers (e.g., glass fibers, carbon fibers, etc.), or secondary products thereof.

Examples of the use for which the composite filament or its secondary products according to the present invention is applied include filters (e.g., filters for air conditioners, air cleaners, vacuum cleaners, etc.), interior materials (e.g., wall sheets, flooring materials, etc.), matting materials (e.g., mats, carpets, etc.), automobile interior materials (e.g., sheet cloths, ceiling materials, flooring materials, etc.), footwear materials, industrial materials, clothing materials, bedding-related materials, hygienic materials, medical materials, daily goods, kitchen utensils, toiletry goods, and packaging materials.

One of these important uses is a front filter for air conditioner or air cleaner. At this time, in many cases, the monofilament is used in a net-like state. In this case, since polypropylene is mainly used for a filter frame, when the kind of the second polyolefin resin (L) as the sheath component Y of the composite filament according to the present invention is chosen, or the amount of the internally added material is regulated, so as to have heat fusion properties, heat fusion between the monofilament and the filter frame can be effected. And, when the monofilament is previously subjected to heat fusion, it gives rise to an advantage that mesh deviation occurred during the secondary processing or practical use can be effectively prevented.

When the composite filament according to the present invention is made to have heat fusion properties, a knitted material of this composite filter is subjected to heat fusion as described above, whereby a heat fused article in a net-like state can be obtained. Further, a heat fused article in a non-woven fabric state can also be obtained from this composite filament.

The present invention is further described below with reference to the following Examples. In these Examples, all parts and percents are on a weight basis.

In the following Examples, the term "MI" (melt index) stands for a gram number of a weight of a sample after extrusion for 10 minutes at a temperature of 190° C. while applying a load of 2,160 g at an orifice bore of 2.092 mm; and the term "MFR" (melt flow rate) stands for a gram number of a weight of a sample after extrusion for 10 minutes at a temperature of 230° C. while applying a load of 2,160 g at an orifice bore of 2.092 mm, respectively.

(Preparation of Materials)

As the first polyolefin resin (H) comprising high temperature-fusible polypropylene were prepared the following two materials.

($H_1$): Polypropylene (PP) having a melting point of 163° C. and an MFR of 3.1

($H_2$): Polypropylene (PP) having a melting point of 163° C. and an MFR of 5.9

As the second polyolef in resin (L) comprising a low temperature-fusible or high temperature-fusible polyolefin were prepared the following three materials.

($L_1$): Polypropylene (PP) having a melting point of 163° C. and an MFR of 3.1

($L_2$): Polypropylene (PP) having a melting point of 128° C. and an MFR of 17.3

($L_3$): High-density polyethylene (HDPE) having an MI of 16.1

As the functional component (A) to be internally added in the side of the second polyolefin resin (L) were prepared the following materials.

($A_1$): 30% Product of tea catechin formulation originated from tea, containing about 30% in total of epigallocatechin, epigallocatechin gallate, epicatechin and epicatechin gallate)

($A_2$): Tea saponin having a purity of 70%

($A_3$): Green tea powder ($A_4$): Powder obtained by drying a hot water-extract of green tea ($A_5$): Tannic acid having a purity of 85%

As a raw material of the ceramics component (C) to be internally added in the side of the second polyolef in resin (L) were prepared the following materials.

($C_1$): Silicate (water glass)

($C_2$): Aluminum phosphate and colloidal silica ($C_2$): Silica, aluminum phosphate and colloidal silica (Preparation of Functional Component (A)-Ceramics Component (C) Composite Particles)

Composite particles comprising the functional component (A) and the ceramics component (C) were produced in the following manners.

Method 1

The raw material ($C_1$) for the ceramics component (C) was prepared in the following manner. That is, the functional material (A) was added to a 1N sulfuric acid solution kept at 0° C., and a 1N water glass solution was separately prepared. Next, the 1N water glass solution was added by dropping over several minutes while vigorously stirring the 1N sulfuric acid solution containing the functional component (A). At this time, the reaction mixture had a temperature of from 5 to 7°C. The mixed solution was washed with running water for one day, and then, the water was well drained off. Thereafter, the residue was finely ground and dried in vacuum in a dryer at a temperature of 50 to 60° C., to obtain a powdered composite.

Method 2

The raw material ($C_2$) for the ceramics component (C) was prepared in the following manner. That is, the functional material (A) was mixed with 200 parts of an aluminum phosphate aqueous solution having a concentration of 25% to adjust a pH at from 3 to 4, and the mixture was further mixed with 130 parts of a colloid solution of colloidal silica (solids content: 40%) to make the pH neutral. Since a slurry had gradually flocculated, it was placed on an evaporating dish (or in a crucible) within a period in which it could be handled and subjected to a heat treatment by drying at from 100 to 300° C. in a constant-temperature dryer or an electric furnace. A rigid, amorphous flocculation product was thus obtained. The obtained flocculation product was finely ground in an automatic mortar (or a ball mill) and screened by a sieve to obtain particles having a particle size of from 100 to 325 mesh. The particles of the flocculation product were then subjected to a heat treatment in a constant-temperature dryer or an electric furnace.

Method 3

The raw material ($C_3$) for the ceramics component (C) was prepared in the following manner. That is, 130 parts of the functional component (A) was dry mixed with 400 parts by weight of silica having a mean particle size smaller than 325 mesh, and 200 parts of an aluminum phosphate aqueous solution having a concentration of 25% was added to and kneaded with the mixture to a degree of an approximately stiff paste. The paste was further mixed with 50 parts of a colloid solution of colloidal silica (solids content: 40%) to make the pH neutral. Since, at this time, flocculation occurred step by step, the mixture was placed on an evaporating dish within a period in which it could be handled and then dried. Thereafter, the dried product was subjected to dehydration and hydrolysis at from 100 to 300° C. and then finely ground.

EXAMPLES 1 to 10

The second polyolef in resin (L) was mixed with the functional component (A)-supported ceramics component (C) obtained in Method 1, 2 or 3 as described above, together with small amounts of an antioxidant and a flocculation preventive (a dispersing agent), and the mixture was melt extruded and palletized. The thus obtained pellets were used as the sheath component Y, and pellets of the above-described first polyolefin resin (H) were used as the core component X. The both pellets were subjected to co-extrusion forming at 230° C. (in the case of using ($L_1$)) or 205° C. (in the case of using ($L_2$) or ($L_3$)) with respect to the sheath component Y and at 230° C. with respect to the core component X, respectively from two extruders each equipped with a composite die, followed by drawing in a drawing ratio of about 6, thereby obtaining a 300-denier monofilament (composite filament). Thereafter, from this monofilament was prepared a net, which was then fixed or heat fused to a polypropylene-made frame to prepare a frame-equipped front filter for air conditioner. The conditions are shown in Table 1.

TABLE 1

| | Side of first polyolefin resin (H) | | Side of second polyolefin resin (L) | | | Composite |
|---|---|---|---|---|---|---|
| | (H) | (A) | (L) | (A) | (C) | particles |
| Comparative Example 1 | ($H_1$): 97 parts | ($A_1$): 3 parts | — | — | — | — |
| Comparative Example 2 | ($H_1$): 97 parts | ($A_2$): 3 parts | — | — | — | — |
| Comparative Example 3 | ($H_1$): 93 parts | ($A_1$): 7 parts | — | — | — | — |
| Comparative Example 4 | ($H_1$): 93 parts | ($A_2$): 7 parts | — | — | — | — |
| Comparative Example 5 | ($H_1$): 50 parts | — | ($L_1$): 46 parts | ($A_1$): 4 parts | | |
| Comparative Example 6 | ($H_1$): 50 parts | — | ($L_2$): 46 parts | ($A_1$): 4 parts | | |
| Example 1 | ($H_1$): 50 parts | — | ($L_1$): 35 parts | ($A_1$): 3 parts | ($C_1$): 12 parts | Method 1 |
| Example 2 | ($H_1$): 50 parts | — | ($L_2$): 35 parts | ($A_1$): 3 parts | ($C_1$): 12 parts | Method 1 |
| Example 3 | ($H_1$): 50 parts | — | ($L_3$): 35 parts | ($A_1$): 3 parts | ($C_1$): 12 parts | Method 1 |
| Example 4 | ($H_1$): 50 parts | — | ($L_2$): 35 parts | ($A_1$): 3 parts | ($C_2$): 12 parts | Method 2 |
| Example 5 | ($H_1$): 50 parts | — | ($L_2$): 35 parts | ($A_2$): 3 parts | ($C_2$): 12 parts | Method 2 |
| Example 6 | ($H_1$): 50 parts | — | ($L_2$): 35 parts | ($A_3$): 3 parts | ($C_2$): 12 parts | Method 2 |
| Example 7 | ($H_1$): 50 parts | — | ($L_3$): 35 parts | ($A_4$): 3 parts | ($C_2$): 12 parts | Method 2 |
| Example 8 | ($H_1$): 50 parts | — | ($L_3$): 35 parts | ($A_5$): 3 parts | ($C_2$): 12 parts | Method 2 |
| Example 9 | ($H_2$): 50 parts | — | ($L_2$): 35 parts | ($A_1$): 3 parts | ($C_3$): 12 parts | Method 3 |
| Example 10 | ($H_2$): 50 parts | — | ($L_3$): 35 parts | ($A_2$): 3 parts | ($C_3$): 12 parts | Method 3 |

COMPARATIVE EXAMPLES 1 to 4

To the first polyolef in resin ($H_1$) was internally added the functional component (A) and subjected to extrusion forming at 230° C., followed by drawing in a drawing ratio of about 6, thereby obtaining a 300-denier monofilament. Using the thus obtained monofilament, a filter was prepared. The conditions are also shown in Table 1.

COMPARATIVE EXAMPLES 5 to 6

The same procedures as in Examples 1 to 8 were followed to effect co-extrusion, except omitting the internal addition of the ceramics component (C) to the second polyolefin resin (L), followed by drawing in a drawing ratio of about 6, thereby obtaining a 300-denier monofilament (composite filament). Using the thus obtained monofilament, a filter was prepared. The conditions are also shown in Table 1.

FIG. 1(i) is a schematically cross-sectional view of the composite monofilament obtained in Example 1; and FIG. 1(ii) is a schematically cross-sectional view of the monofilament obtained in Comparative Example 1.

Each of the filters as prepared above was dipped in water at a normal temperature for 3 hours and then once taken out, followed by spontaneous drying. Thereafter, the filter was again dipped in water for 3 hours and then taken out, followed by spontaneous drying. The amounts of the functional component (A) before the first dipping in water and after the second dipping in water were measured by thermal analysis by means of a differential calorimeter (the temperature was elevated at a rate of 5° C./min in an electric furnace, and a heat balance (endothermic heat/exothermic heat) of the sample during the heating step and an accompanying increase or decrease in weight were analyzed). And, the filters before and after the water washing were subjected to a deodorizing properties test and an antimicrobial properties test under the following conditions. The results obtained are shown separately in Tables 2 and 3.

(Deodorizing Properties Test)

In a $1m^3$ vessel was placed an air cleaner having each of the filters as described above equipped therein, which could be operated externally, and five cigarettes were installed in a smoke absorber and ignited in the vessel. When the first cigarette had burnt out, the smoke absorber was stopped and when the last cigarette was burnt out, the operation of the air cleaner was started. An ammonia concentration was measured by using a gas detector tuber 5 minutes and 30 minutes after the start of the operation. Then, a deodorizing rate was determined by how the concentration was decreased after 30 minutes, as compared with the concentration (initial concentration) after 5 minutes.

(Antimicrobial Properties Test)

Each of the samples was examined for the antimicrobial properties under the following conditions.

Test item: Test for rate of decrease in number of bacteria

Test bacterium: *Staphylococcus aureus* ATCC 6538P

Test method: According to uniform test method

Test results:

Number of planted bacteria (A):

$1.0\times10^5$ log A=5.0

Number of bacteria on non-processed cloth (B):

$1.6\times10^7$ log B=7.2

(A standard cotton cloth was used as the non-processed cloth.)

log B−log A=2.2>1.5 (the test was effective)

Increase or decrease value=log C−Log A

Difference in increase or decrease value=(log B−log A)−(log C−log A)

TABLE 2

| | Comparative Example | | | | | | Example | |
|---|---|---|---|---|---|---|---|---|
| | 1 | 2 | 3 | 4 | 5 | 6 | 1 | 2 |
| Before water washing | | | | | | | | |
| Content of (A) (%) | 2.1 | 2.2 | 4.7 | 4.8 | 2.8 | 3.0 | 2.8 | 2.8 |
| After dipping in water | | | | | | | | |
| Content of (A) (%) | 0.3 | 0.3 | 0.7 | 0.6 | 0.2 | 0.2 | 2.7 | 2.7 |
| Deodorizing rate of $NH_3$ (%) | 48 | 48 | 54 | 53 | 43 | 43 | 76 | 76 |
| Antimicrobial properties | | | | | | | | |
| Number of bacteria, log C | 6.8 | 6.8 | 6.5 | 6.5 | 7.1 | 7.0 | 3.7 | 3.7 |
| Increase or decrease value | 1.8 | 1.8 | 1.5 | 1.5 | 2.1 | 2.0 | −1.3 | −1.3 |
| Difference in increase or decrease value | 0.4 | 0.4 | 0.7 | 0.7 | 0.1 | 0.2 | 3.5 | 3.5 |

(For the antimicrobial properties test, 0.2 g of the sample was collected.)

TABLE 3

| | Example | | | | | | | |
|---|---|---|---|---|---|---|---|---|
| | 3 | 4 | 5 | 6 | 7 | 8 | 9 | 10 |
| Before water washing | | | | | | | | |
| Content of (A) (%) | 2.8 | 2.8 | 2.8 | 2.7 | 2.8 | 2.6 | 2.8 | 2.8 |
| After dipping in water | | | | | | | | |
| Content of (A) (%) | 2.7 | 2.7 | 2.7 | 2.7 | 2.7 | 2.4 | 2.7 | 2.7 |
| Deodorizing rate of $NH_3$ (%) | 77 | 77 | 74 | 73 | 76 | 72 | 77 | 77 |
| Antimicrobial properties | | | | | | | | |
| Number of bacteria, log C | 3.7 | 3.7 | 3.7 | 3.9 | 3.8 | 4.1 | 3.7 | 3.6 |
| Increase or decrease value | −1.3 | −1.3 | −1.3 | −1.1 | −1.2 | −0.9 | −1.3 | −1.4 |
| Difference in increase or decrease value | 3.5 | 3.5 | 3.5 | 3.3 | 3.4 | 3.1 | 3.5 | 3.6 |

(For the antimicrobial properties test, 0.2 g of the sample was collected.)

It is understood from Tables 2 and 3 that, in Comparative Examples 1 and 2 in which the internal addition amount of the functional component (A) is 3 parts, the functionalities after dipping in water are insufficient. Further, it is understood that, in Comparative Examples 3 and 4 in which the internal addition amount of the functional component (A) is 7 parts, the functionalities after dipping in water are insufficient, too. In Comparative Examples 5 and 6 with respect to the composite filament, since the functional component (A) is internally added in the side of the sheath component Y as the external layer, the functionalities after dipping in water are more insufficient. Further, when drawn articles of a monofilament made of the first polyolefin resin ($H_1$) or ($H_2$) only, in which the functional component (A) is not internally added, the deodorizing rate of $NH_3$ is about 40%, and hence, a "(measured value) —40%" value is a substantial deodorizing rate. Further, it is understood that, in the Comparative Examples (in particular, Comparative Examples 1 to 5 in which the melt extrusion was carried out at 230° C.), the ceramics component (C) is not co-existent, and hence, a considerable amount of the functional component (A) was volatilized out during the extrusion forming.

(Antiviral Properties Test)

Using each of the composite filaments obtained in Examples 1, 4, 5 and 9 and of a composite filament (control) composed of the first polyolef in resin ($H_1$) and the second polyolefin resin ($L_1$) in a weight ratio of 1:1, a specimen (3 cm×3 cm) comprising a filter for air conditioner was prepared. To the specimen was added by dropping 0.2 ml of an influenza virus-floating solution, followed by storing at 25° C. Twenty-four hours after the storage, the virus on the specimen was washed away, and a logarithmic value of a virus infection value (a 50% tissue culture infectious dose ($TCID_{50}$) per ml) was measured. The results obtained are shown in Table 4.

TABLE 4

| | log $TCID_{50}$/ml | |
|---|---|---|
| | At the start | After 24 hours |
| Control | 5.3 | 5.3 |
| Example 1 | 5.3 | 3.5 |
| Example 4 | 5.3 | 3.5 |
| Example 5 | 5.3 | 3.5 |
| Example 9 | 5.3 | 3.5 |

In the composite filaments according to the present invention, necessary spinning properties, stretching properties and physical properties (e.g., strength, dimensional stability) are obtained mainly by the core component X, and functionalities such as deodorizing properties, antimicrobial properties, physiological activity, and antioxidation properties are obtained by the sheath component Y. When the kind and the internal addition amount of the second polyolefin resin (L) are selected or controlled, preferred heat fusion properties are obtained.

And, since in the sheath component Y, the functional component (A) is fixed and made waterproof in the co-existence of the ceramics component (C), not only the functional component (A) is hardly lost due to volatilization during the melt forming, but also bleeding of the functional component (A) internally added is effectively inhibited. Further, due to the functional component (A) present in the sheath component Y, superior functionalities that the functional component (A) inherently possesses, such as deodorizing properties and antimicrobial properties, are exhibited at the maximum. Moreover, even when the composite filament according to the present invention is used in a state in which it is brought into contact with water or washed with water, since the functional component (A) does not readily elute out, the functionalities are maintained over a long period of time. The presence of the ceramics component (C) also contributes to the dimensional stability and heat resistance of the filament against circumferential changes such as temperature and humidity changes.

In addition, since it is only a requirement that the functional component (A) is present in the sheath component Y in the surface side, the internal addition amount of the functional component (A) can be largely reduced, leading to an advantage from the economic standpoint.

Besides, since the functional component (A) is a component contained in a tea or the like, it is safe even when the filament is used in a state in which it is brought into contact with a human body.

While the invention has been described in detail and with reference to specific examples thereof, it will be apparent to one skilled in the art that various changes and modifications can be made therein without departing from the spirit and scope thereof.

What is claimed is:

1. A composite filament comprising a core component X and a sheath component Y, wherein the core component X is formed from a first polyolefin resin (H), and the sheath component Y is formed from a second polyolefin resin (L) compounded with at least one functional component (A) selected from the group consisting of a catechin, a saponin, a tea-leaf powder, a tea-leaf extract, and tannin (tannic acid), and wherein the first polyolefin resin (H) has a melting point either higher or lower than that of the second polyolefin resin (L).

2. The composite filament as claimed in claim 1, wherein the sheath component Y is formed from the second polyolefin resin (L) having the functional component (A) and a ceramics component(C) compounded therein in a state of composite.

3. The composite filament as claimed in claim 1, wherein the first polyolefin resin (H) has a melting point higher than that of the second polyolefin resin (L).

4. The composite filament as claimed in claim 1, wherein a weight ratio of the core component X to the sheath component Y is from 30:70 to 80:20.

5. The composite filament as claimed in claim 1, wherein the ceramics component (C) is a silica gel obtained via a hydrous silicate gel, a combination of an inorganic sintering aid and an inorganic flocculant, or a combination of ceramics particles, an inorganic sintering aid and an inorganic flocculant.

6. A filter comprising the composite filament as claimed in claim 1.

* * * * *